United States Patent [19]

Germunson

[11] Patent Number: 4,619,104

[45] Date of Patent: Oct. 28, 1986

[54] NET BAG FORMING METHOD AND MACHINE

[75] Inventor: Gary Germunson, Yakima County, Wash.

[73] Assignee: Yakima Wire Works, Inc., Yakima, Wash.

[21] Appl. No.: 696,723

[22] Filed: Jan. 31, 1985

[51] Int. Cl.[4] ..... B65B 9/13

[52] U.S. Cl. ..... 53/459; 53/390; 53/469; 53/568

[58] Field of Search ..... 53/390, 459, 469, 567, 53/568, 570, 585; 242/75.5; 493/302

[56] References Cited

U.S. PATENT DOCUMENTS

| | | | |
|---|---|---|---|
| 2,523,571 | 9/1950 | Humm | 242/75.5 |
| 2,665,043 | 1/1954 | Draper . | |
| 2,816,758 | 12/1957 | Danly | 242/75.5 |
| 2,847,806 | 8/1958 | Wang . | |
| 3,070,927 | 1/1963 | Lundahl | 53/567 |
| 3,287,881 | 11/1966 | Jelling et al. . | |
| 3,360,901 | 1/1968 | Gallo | 53/567 |
| 3,550,353 | 12/1970 | Haadsma | 53/390 |
| 3,812,642 | 5/1974 | Mintz et al. . | |
| 3,889,453 | 6/1975 | Hirai | 53/390 |
| 3,903,678 | 9/1975 | Bowman et al. . | |
| 3,939,628 | 2/1976 | Schjeldahl | 53/459 |
| 3,974,628 | 8/1976 | Konstantin | 53/585 |
| 4,170,097 | 10/1979 | Floet et al. . | |

FOREIGN PATENT DOCUMENTS

| | | | |
|---|---|---|---|
| 2227994 | 11/1974 | France | 53/567 |

OTHER PUBLICATIONS

Kwik Lok Corporation, 1001 (Ten-O-One) Net Bag Closing Machine.

*Primary Examiner*—Robert L. Spruill
*Assistant Examiner*—Donald R. Studebaker
*Attorney, Agent, or Firm*—Seed and Berry

[57] ABSTRACT

A novel machine for forming bags from expandable continuous rope net material having a spherical expanding body positioned within the tubular net material to expand the material as the material is drawn around the body and a basin for supporting the body. The machine also has mechanisms to seal the bottom of the expanded material and to adjust the machine to form bags of different lengths.

22 Claims, 10 Drawing Figures

NET BAG FORMING METHOD AND MACHINE

DESCRIPTION

1. Technical Field

The invention relates to an apparatus and method for forming bags from expandable material. Specifically, the present invention relates to a method and apparatus for forming expanded net bags from continuous tubular netting which has been radially compacted and stored on a reel.

2. Background Art

The packaging of produce and other objects of variable shapes has been greatly facilitated by the introduction of bags made from expandable net material. The material is biased to assume a contracted shape. Thus, bags made from this material can contract around such objects to make a form fitting bag. The material is usually supplied on a reel from the manufacturer. The packager must unroll the material to the desired length, expand the material to accept items to be bagged, seal one end of the material to form the bottom of a bag, separate the completed bag from the remaining net material and then fill the bag.

The same properties which make this material attractive for packaging purposes also cause serious handling and bag forming problems. The material's natural tendency to contract axially and radially necessitates expanding the material before loading. Opening the material manually, filling the bag and sealing it is a frustrating and time-consuming practice. Devices have been made available to facilitate and expedite expanding and loading the material. Devices presently available, such as the device manufactured by Kwik Lok Corporation, require an operator to unroll a portion of the material from the reel sufficient to make a number of bags. This material is cut off the roll and then stretched or "rucked" over the opening of an elongated tube, the diameter of the tube approximating the diameter of a finished bag. Initially, sufficient material to make a number of bags is expanded around the tube and remains on the exterior surface of the tube as each bag is formed. The natural tendency of the material to constrict prevents the material from sliding off the tube. A length of material, sufficient to make one bag, is pulled off the tube and sealed at its lower end to make the bottom of the first bag. Product is then dropped through the length of the tube and the length of the bag into the bottom of the bag. After the bag is filled, the net is cut away from the tube, and a new length of material pulled off the tube to repeat the process.

There are a number of disadvantages associated with this device. The operator must manually expand a substantial length of material over the tube in order to make a number of bags. The number of bags which can be made before the operator must reload the tube is therefore limited by the length of the tube. However, as the tube is lengthened, the produce must drop through an increasing distance before reaching the bottom of the first bag, increasing bruising of delicate produce. Produce such as apples, therefore, cannot be bagged in a machine of this type.

To overcome the disadvantages of the abovedescribed device, machines using free-floating conical bodies, to expand the netting, have been developed. Illustrative of these devices is that disclosed by Hirai in U.S. Pat. No. 3,889,453. In this device, the continuous rope netting is expanded around a main cylindrical block having a conical wall face. The block is seated in an aperture of a supporting member. The weight of this block expands the netting as the netting is pulled vertically through the aperture and around the block. The supporting member prevents the block from falling further into the material. When a length of material sufficient to form a bag has been expanded, the bottom of the bag is formed above the block. Although this device eliminates the excessive drop through which produce must pass and allows the use of material directly from the manufacturer's roll, other disadvantages are associated with this device. The net material can only be expanded around the free-floating conical body or block with a minimum of effort if the material is pulled around the block in the direction of the axis of the block. Deviation from this direction requires the operator to exert extra effort to expand the material. This is especially disadvantageous when a human operator is used to expand the material around the block. Furthermore, it is also known that the material, as supplied by the manufacturer, is rolled onto the reel with a slight twist. Therefore, the net material tends to knot beneath the block after forming twenty to thirty bags.

The present invention avoids the disadvantages of the above-described devices by allowing a human operator to pull the material up around an expanding device with a minimum of effort, regardless of the direction through which the material is pulled. Delicate produce can be loaded into the formed bad without passing through a length exceeding the length of the bag, thereby avoiding bruising. The shape of the expanding device encourages the material to twist around the device, thereby avoiding knotting of the continuous net material.

DISCLOSURE OF THE INVENTION

It is object of the present invention to facilitate the formation of net bags from continuous net bag material.

It is also an object of the present invention to allow tubular net material to be easily and expeditiously expanded around a body regardless of the direction in which the material is advanced.

It is another object of the invention to allow the net material to twist around the body as the material is expanded to prevent the material from knotting beneath the body.

The invention achieves these objectives by providing a slippery, spherical expanding body or mandrel for expanding the tubular net material. The mandrel is contained within a basin which prevents excessive lateral movement of the mandrel as an operator draws material through the basin and around the mandrel, thus expanding the net material in preparation for loading. The base of a bag is formed above the mandrel and is separated from the continuous material. The bag thus formed is ready to be loaded with articles.

In one embodiment a spherical body or mandrel is nested within a basin. The mandrel can be made from any material which can be machined or molded so as to have a smooth surface. The basin has a depression to accept the mandrel and to prevent excessive lateral movement of the mandrel while the material is drawn through the mandrel by an operator. The mandrel can, however, roll freely within the basin while expanding the material.

To form a bag, continuous tubular netting, as supplied from the manufacturer's reel, is fed through an aperture in the bottom of the basin. The operator then inserts the spherical mandrel into the tubular netting. The mandrel has sufficient weight to overcome the natural tendency of the material to constrict in diameter, and expands the material as it is drawn around the mandrel by the operator. It is highly desirable to construct the ball and the depression from material providing an extremely smooth and slippery surface so that the only resistance to be overcome by the operator is the tendency of the net to constrict around the mandrel. The aperture within the basin is sufficiently small to prevent the mandrel from falling therethrough, allowing the basin to support the mandrel.

The operator grasps a portion of the material which has been expanded and which is located on the surface of the mandrel. The operator then draws the material from the mandrel, the mandrel will roll within the material while it expands the material. The material is discouraged from knotting beneath the mandrel because the mandrel is free to roll with any twist which the material may have. When a sufficient length of material has been expanded to form a bag, the operator hooks a portion of the top circumference of the netting around an extended lever, further opening the top of the net. The lever operates a switch, which initiates a series of events.

The mandrel and basin are automatically removed from their normally extended position near the operator into a horizontally retracted position, away from the operator and into a bottom forming device. This device forms the bottom of the net bag above the top of the spherical mandrel. In addition a packing device or packer arm may be provided to force a portion of the material further into the bottom forming device. The packer arm may also serve to support articles loaded into the bag above the operating portion of the bottom forming device. The device seals a portion of the expanded material above the free-floating mandrel and separates the bottom of the formed bag from the continuous material. A hopper, loaded with a predetermined volume of fruit, produce, or other goods, releases this load into the net bag on command from the operator. The filled bag is then removed. The mandrel and basin then automatically move back into the horizontally extended position in front of the operator. The operator now finds the top portion of a new section of the tubular netting on the surface of the spherical mandrel and begins the sequence again.

The spherical shape of the mandrel permits the operator to draw the netting from the mandrel through a range of angles away from the vertical without experiencing any appreciable increase in resistance. In the preferred embodiment, the basin has a hemispherical depression, having a radius of curvature slightly larger than the radius of the mandrel. Thus the surface area of contact between the mandrel and basin is similar for a variety of angles through which an operator might pull the material from the mandrel. In this embodiment an operator can form a net bag with facility, regardless of the direction in which he draws the net through the mandrel.

To facilitate drawing a supply of material through the basin and around the mandrel, automatic supply means are added to release material directly from the manufacturer's roll, on demand from the operator. In one embodiment, the roll is placed on a horizontally positioned axle. The net material is fed beneath a sensing mechanism into the basin. As the operator draws on the material, the sensing mechanism detects tension in the material. The mechanism then starts a motor which causes the axle to rotate. A timer stops the motor after about 20–30 feet of material has been unrolled. Thus, the operator need only pull against the natural resistance of the net material to expansion by the mandrel and not against the rotational inertia of a fully loaded reel.

BEST MODE FOR CARRYING OUT THE INVENTION

Referring now in detail to the drawings, like numerals herein designate like numbered parts in the figures.

Figure 1:
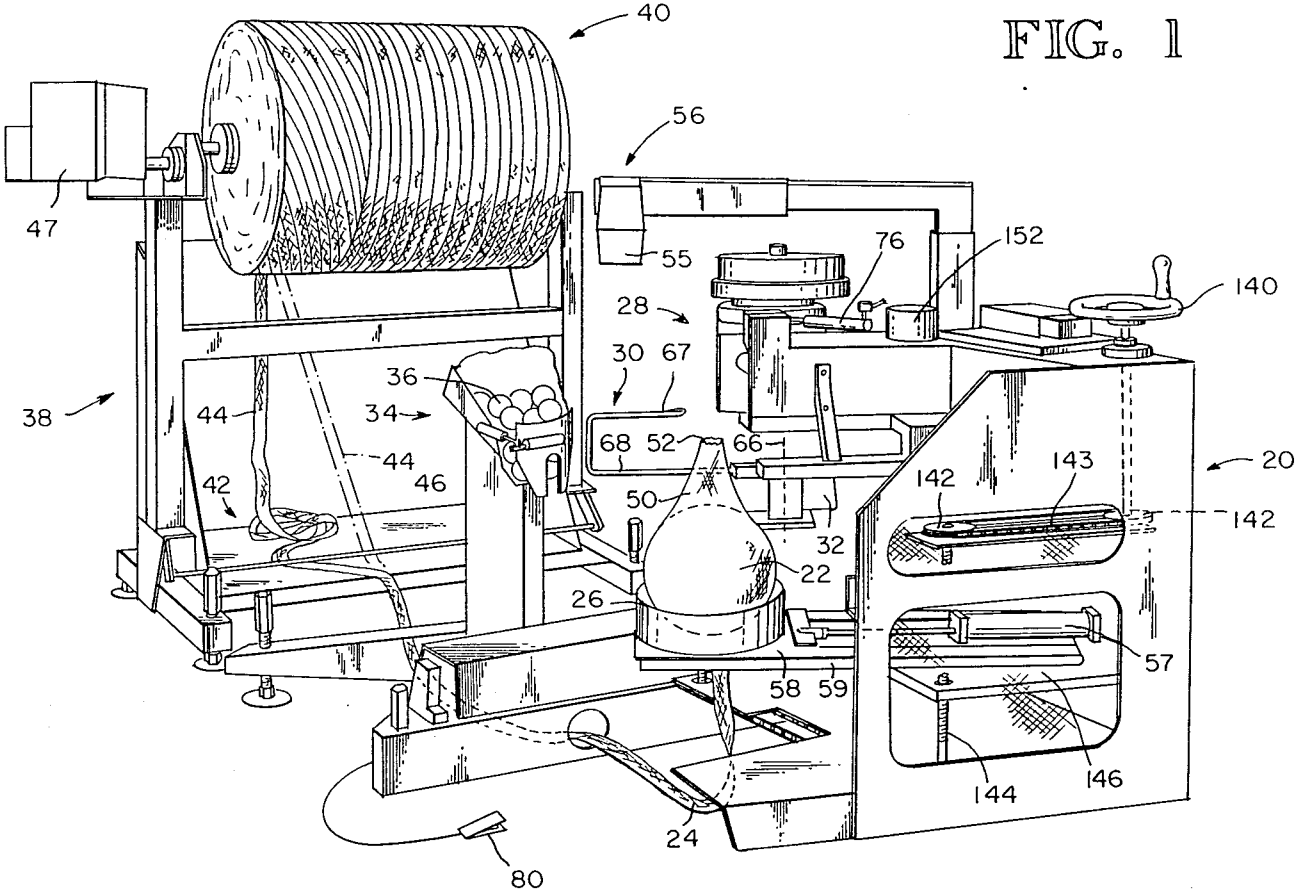
FIG. 1 is an isometric view of the net bag forming machine including the rope net feed device and a section of the loading device.

In FIG. 1, a net bag forming machine in accordance with the present invention, is generally indicated at 20. The machine has: a spherical mandrel 22, for expanding continuous rope net material 24; a basin 26, to prevent substantial lateral movement of the mandrel; a bottom forming device 28, to form the bottom of a completed bag; a packer arm 30 for maintaining a portion of the material in the correct position within the bottom forming device; and a rotary actuator 32 to engage the packer arm with the material and the bottom forming device. The machine also has a loading station 34 for loading a formed bag with a predetermined volume of articles 36. The machine additionally has a rope net dispensing device, generally indicated at 38, to release material on demand.

The net bag material 24 is supplied from the manufacturer on a large reel 40. The material is regularly compacted to a diameter of less than 1", although its expanded lay-flat dimension can be anywhere from 9"–12". The reel is carried on a frame 38 and can unroll about 20 feet of slack material 42 when the material is tensioned. The material is dispensed on demand. Tension in the material is detected through the switch bar 46, which activates a motor to rotate the reel, tangentially dispensing a length of material. A time delay mechanism stops the rotation after about 20 feet of material have been coiled at the base of the dispenser, as indicated by reference numeral 42 in FIG. 1. Alternatively, a length of material can be played off the reel manually without the use of a dispenser motor. Once a sufficient length of material has been removed from the reel, the material is fed through an aperture in the basin, generally indicated by dotted lines at reference numeral 48 in FIG. 6. The operator then drops the spherical mandrel into the net material, allowing the mandrel to rest within the basin. The material thus surrounds and contracts about the surface of the mandrel while the basin prevents the mandrel from falling further into the material.

Figure 2:
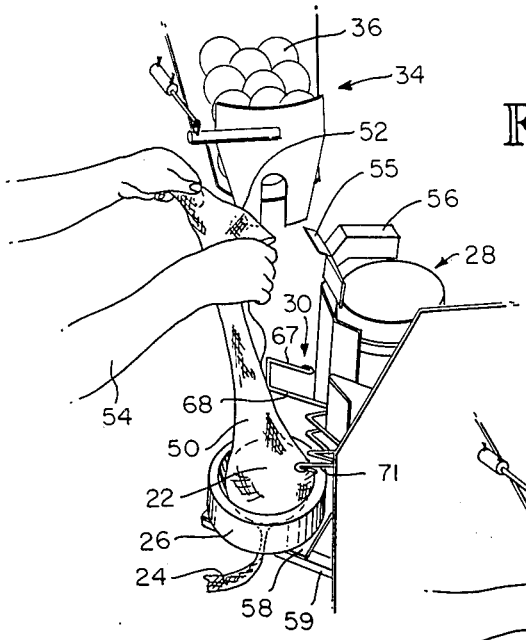
FIG. 2 is an isometric view illustrating an operator drawing the net material around the spherical mandrel to expand the material.

To begin forming a bag, the operator slides the expanded mandrel 50 back over the surface of the mandrel to facilitate grasping the free end 52 of the expanded material. As illustrated in FIG. 2, the operator 54 draws the material from the mandrel, expanding the material as the mandrel rolls within the material. The mandrel is sufficiently heavy to remain seated in the basin as the material is drawn around it. A 6" diameter mandrel constructed from ultra high molecular weight polyethylene has been found to have sufficient mass to expand compacted tubular rope net material which has a lay flat dimension of 9"–13". If the mandrel is made from a lower density material, the mandrel can be drilled and weighted to achieve sufficient mass to expand the material without having the mandrel escape from the basin as the material is drawn around the mandrel. The basin generally serves to support the mandrel and to prevent excessive lateral movement of the mandrel.

Figure 3:
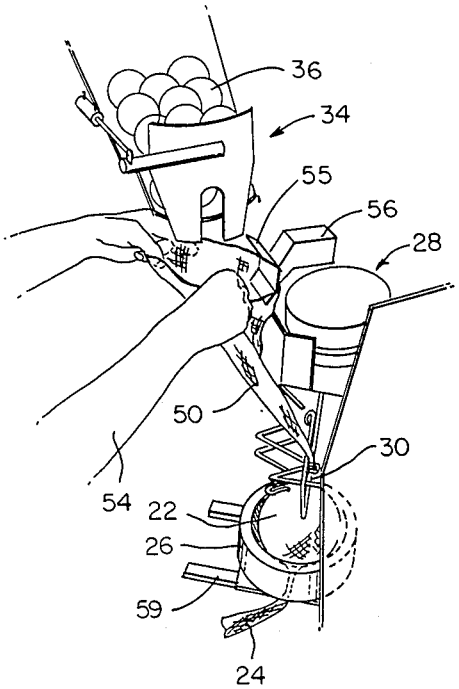
FIG. 3 is an isometric view illustrating the function of the packer arm and the enabling switch activated by the top of the expanded material.

As shown in FIG. 3, the operator 54 next hooks a portion of the free end 52 of the expanded material 50 behind the protruding portion 55 of a bag operated switch or valve 56. The operator opens the free end of the bag by pulling the free end of the material against the switch protrusion to enable the switch and to prepare the bag for loading. The bag operated switch thus enabled, the basin 26 and mandrel 22 are retracted by the retracting mechanism or cylinder 57 on a basin mounting tray 58 into the vicinity of the bottom forming device 28. The basin mounting tray slides on tracks 59.

In the preferred embodiment the retracting mechanism is a double-acting pneumatic cylinder and piston and the bag operated switch is a pneumatic valve. The preferred system or means for controlling and actuating the various elements of the machine is pneumatic, due to the inherent safety of such system. However, hydraulic, electro-mechanical, or other functionally equivalent systems may be substituted for the preferred pneumatic system. It is to be understood that the invention is not limited to the preferred pneumatic system.

Figure 7:
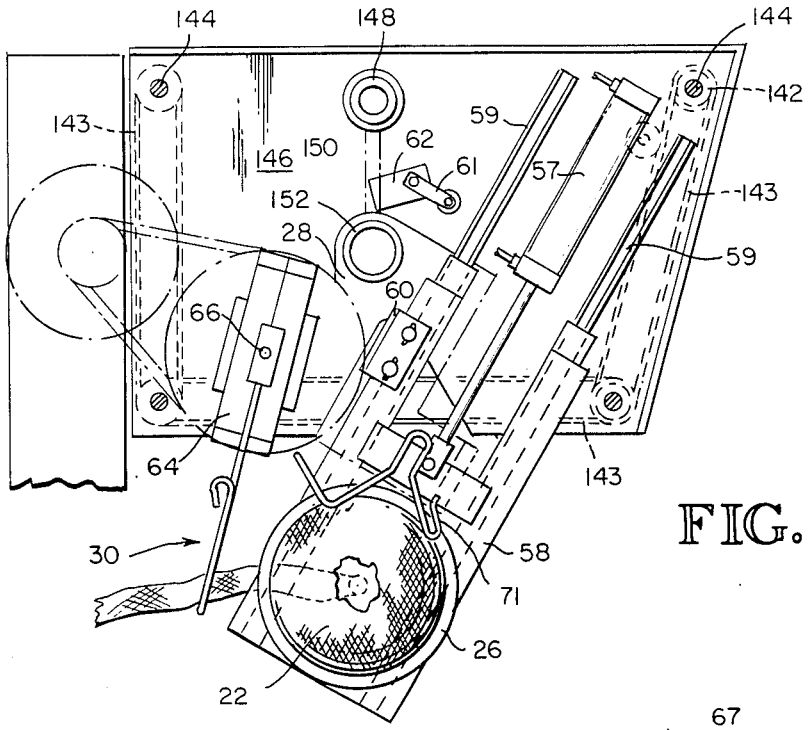
FIG. 7 is a top plan view of the machine showing the mandrel and basin in the extended position and the packer arm also in the extended position.
Figure 9:
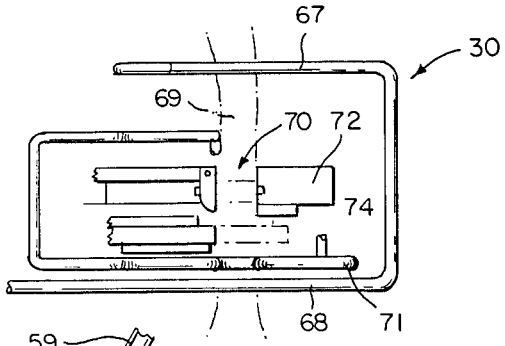
FIG. 9 is a frontal elevation of a portion of the bottom forming device.
Figure 8:
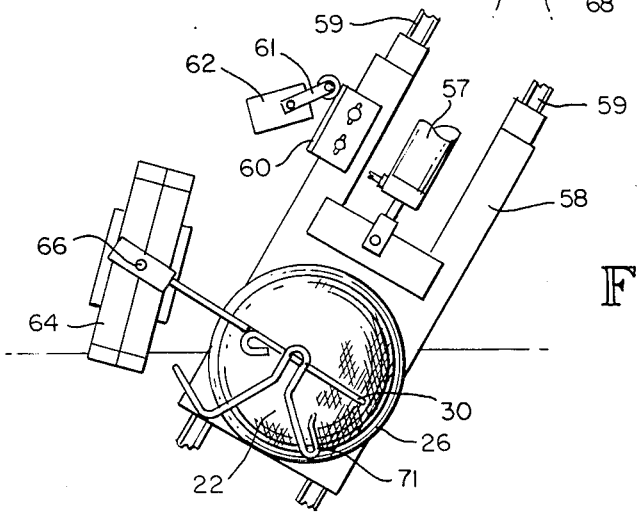
FIG. 8 is a top plan view showing the basin, mandrel and packer arm in the retracted position.

The basin and mandrel are shown in the extended position in FIGS. 1, 2 and 7 and in the retracted position in FIGS. 3, 4, 5 and 8. As the basin and mandrel move to the retracted position in FIG. 8 a striker 60 activates a packer arm switch or pneumatic valve 62. The packer arm valve enables a rotary activator 64, such as the Rotary Activator, R11 2090-P made by PHD Industries, Fort Wayne, Ind., to rotate the packer arm 30 about a packer arm vertical axis 66 shown in FIGS. 1, 7 and 8. The packer arm has an upper part 67 and a lower part 68 to force a bottom forming portion 69 of the expanded net material 50 into the correct vertical position within the mouth 70 of the bottom forming device 28. In FIGS. 8 and 9, the packer arm has rotated counterclockwise about its vertical axis to crowd the bottom forming portion of the expanded material into the mouth of the bottom forming device. A stationary V-shaped guiding arm 71 is provided to assist the packer arm in crowding the expanded material into the mouth of the bottom forming device.

The bottom forming device is a conventional stapler-cutter such as Model LHC made by the New Jersey Stitching Machine Company, Camden, N.J., and has a stapling portion 72 and a cutting portion 74 to form the bottom of a completed bag.

As shown in FIGS. 8 and 9, the packer arm and the guiding arm hold the material in the proper position within the mouth of the bottom forming device, causing all of the material to be within the stapling and cutting portions so that a finished bottom can be formed.

Once the mandrel 22 and basin 26 have moved into the retracted position, causing the packer arm 30 to rotate and force the bottom forming portion 69 of the expanded net material 50 into the bottom forming device 28, a clutch activator 76 in FIG. 1 is activated to energize the bottom forming device clutch. The stapler portion 72 and cutting portion 74 then staple and cut the bottom forming portion 69 of the expanded net material 50. Thus the bottom of a completed net bag is formed.

FIG. 3 illustrates the position of the expanded material 50 during the bottom forming process. The portion of the expanded material near the packer arm 30 is both horizontally and vertically displaced from the loading station 34. The horizontal displacement is preferred because the vertical drop through which the articles 36 must fall is interrupted by the walls of the expanded material. Thus, the vertical drop experienced by articles as they fall from the loading station is substantially less than the full length of a formed bag. Furthermore, the articles experience a relatively moderate deceleration due to the elastic property of the walls of the material. It has been shown that delicate produce, such as apples, can be loaded by this machine without bruising.

The horizontal displacement of the mandrel 22 on basin 26 when in the retracted position also ensures the safety of the operator 54 since the bottom forming operations occur in a position removed from the operator.

Figure 4:
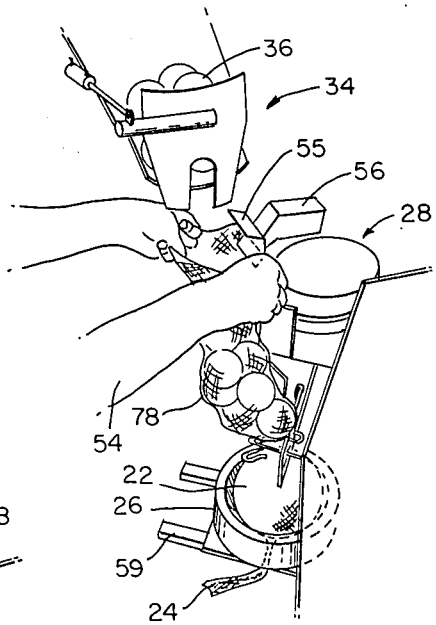
FIG. 4 is an isometric view illustrating the loading process.
Figure 5:
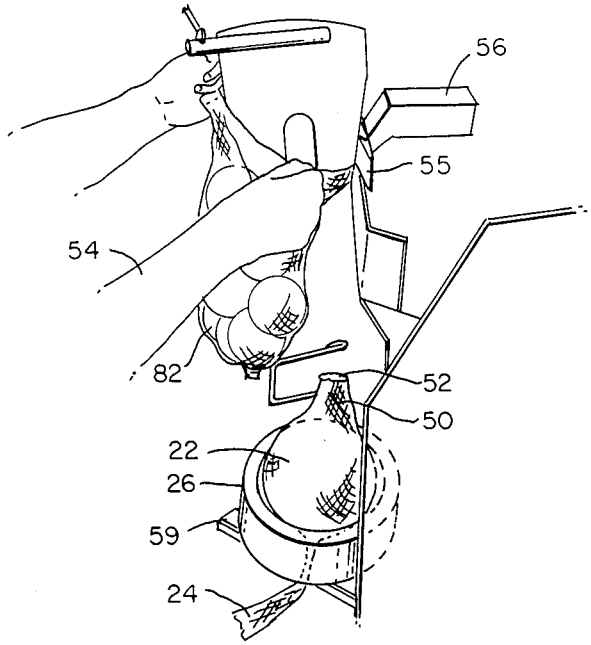
FIG. 5 is an isometric view illustrating the removal of a formed and loaded bag.

The operator may, at any time, release the articles 36 in the loading station 34 into the formed bag 78, as shown in FIG. 4, by means of foot pedal 80 in FIG. 1. The loading station can be a well-known type, such as the MSU-2000 manufactured by Yakima Wire Works, Inc., Yakima, Wash. It is preferred to fill the material 50 while the mandrel, basin and packer arm are in the retracted position as shown in FIG. 4, to utilize the reduced vertical drop associated with this position. The upper portion 67 of the packer arm 30 will also prevent articles from falling through the material into the cutting and stapling portions of the bottom forming device. Furthermore, loading the articles at this time shortens the duration of the forming and loading process. A completed and filled bag 82 is shown in FIG. 5 being removed from the machine.

Figure 10:
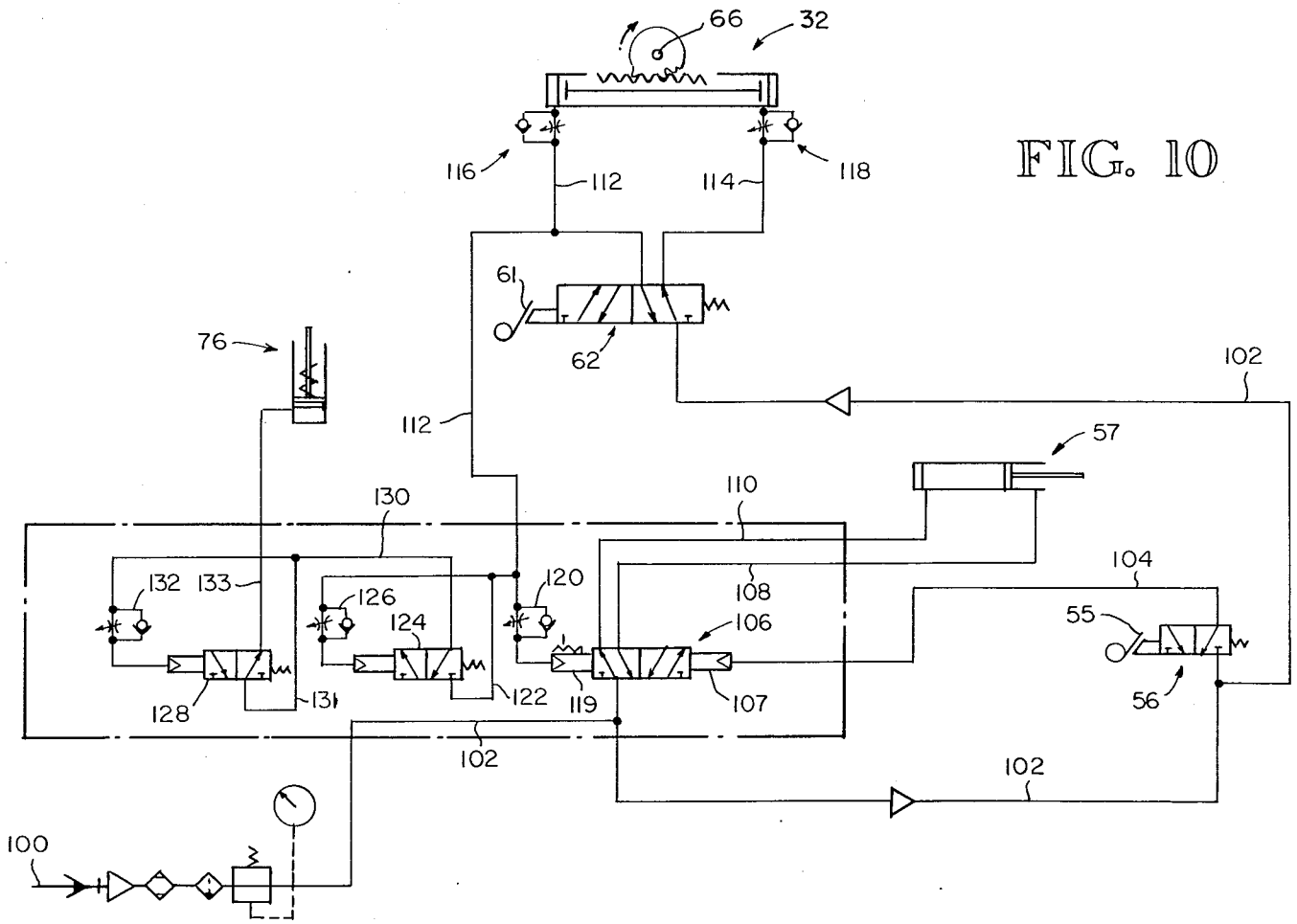
FIG. 10 is a pneumatic diagram of the control means for the net bag forming machine.

A timing valve 120 (FIG. 10) then causes the retracting cylinder 57 to move the mandrel 22 and basin 26 to the original extended position, deactivating the packer arm valve 62 and causing the packer arm 30 to release the formed and filled bag 82.

Figure 6:
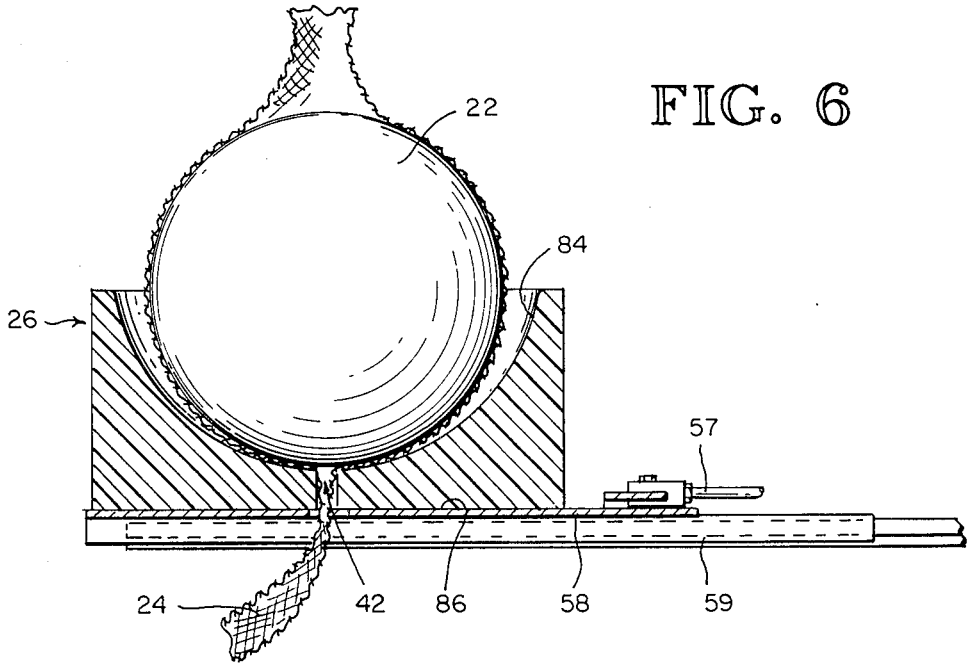
FIG. 6 is a side elevation, partially cut away, showing the spherical mandrel and the basin.

A partial side elevation of the mandrel 22 and basin 26 is provided in FIG. 6. In the preferred embodiment the depression 84 of the basin is hemispherical and has a radius of curvature which is larger than the radius of the sphere, to allow the sphere to roll freely within the basin. This embodiment is preferred because the surface of contact between the mandrel and basin remain substantially constant for a large range of angles through which an operator might draw the material from the mandrel. Thus an operator experiences a constant resistance when expanding the material, and need not continually pull the material in the same direction to experience minimum resistance. It has been found that this feature is especially advantageous in increasing the productivity of a human operator.

It is to be understood that the invention is not to be limited to a hemispherical depression within the basin, although that shape is preferred. Other geometries which serve to limit the lateral displacement of the mandrel within the basin can be substituted.

The aperture 42 within the basin 26 provides a communicating passage between the surface of the depression 84 and the base 86 of the basin for the compacted net material 24. The aperture has a minimum dimension which is smaller than the diameter of the mandrel 22 to prevent the mandrel from passing through the aperture.

A pneumatic control and activating system is provided to operate various elements of the net bag forming machine 20. A pneumatic diagram is provided in FIG. 10. It is to be understood that equivalent, non-pneumatic control and activating systems, including but not limited to hydraulic and electro-mechanical systems may be substituted.

Pressurized air is introduced into the system at the inlet port 100. All valves and devices are shown in their respective normal rest positions, corresponding to the initial positions of the various elements in FIG. 1. The operator initiates the air logic by operating the bag operated valve 56 through actuator 55. Valve 56 is a conventional three-way, two-position, three-ported cam operated directional valve, normally biased by a spring to prevent air from passing from line 102 to line 104. When operated, valve 56 allows air to pass through line 104 to the retracting cylinder valve 106. The retracting cylinder valve is a conventional four-way, two-position, five-ported double pilot detented directional control valve. Air from line 104 passes through the first retracting cylinder valve pilot 107 and moves valve 106 to the left, allowing air from line 102 to pressurize line 108, causing the retracting cylinder 57 to move the mandrel 22, basin 26 and striker 60 into the retracted position. Air in the unpressurized side of the retracting cylinder is vented to the atmosphere through line 110. The striker, when retracted, engages actuator 61 of the packer arm valve 62, also seen in FIG. 8. Valve 62 is moved to the right, causing air from line 102 to pressurize line 112. The packer arm valve 62 is a conventional four-way, two-position, five-port, cam operated directional valve. (In the normal spring-biased position, corresponding to the mandrel in the extending position, line 102 pressurizes line 114 and causes the rotary actuator 32 to hold the packer arm 30 in its normally open position, that is rotated clockwise about packer arm verticle axis 66. Time delay valves 116 and 118 are provided to slow the rotation of the packer arm about the vertical axis.) Pressure from line 112 causes the rotary actuator to rotate the packer arm counterclockwise about the vertical axis 66, forcing the packer arm to crowd the bottom forming portion 69 of the expanded material 50 into the mouth 68 of the bottom forming device, as seen in FIGS. 8 and 9. This is desirable as, in FIG. 3, the material has been expanded up to the loading station 34 and the basin is in the retracted position, ready for the bottom forming portion of the expanded material to be stapled and cut.

Pressure from line 112 also pressurizes: the second retracting cylinder valve pilot 119 through retracting cylinder valve time delay 120; line 122; and the pilot of the first clutch actuator valve 124 through a first clutch actuator valve time delay 126. However, the retracting cylinder valve time delay 120 prevents the retracting cylinder valve 124 from moving back to its original position until a series of events have occurred. The first clutch activator valve 124 is a conventional three-way, two-position, three-ported single pilot directional control valve as is the second clutch activator valve 128.

The first clutch activator time delay 126 allows first clutch activator valve 124 to move from its normally spring-biased first position to the right, and pressure from line 122 is passed to line 130 and line 131, energizing clutch activator 76 through line 133. In FIG. 9, stapling portion 72 and cutting portion 74 of bottom forming device 28 will then staple and cut the bottom forming portion 69 from the expanded material 50 in a conventional manner.

The second clutch activator valve 128 is piloted by the second clutch activator valve time delay 132. The second clutch activator time delay has a slightly longer time delay than the first clutch activator time delay 126. Thus, the second clutch activator valve 128 only allows air to pass from line 131 to line 133 for a very short time after line 130 has been pressurized, effectively pulsing the clutch activator 76, causing the stapling portion and the cutting portion of the bottom forming device to close and open quickly.

After the clutch activator 26 has deactivated (i.e., line 133 has been vented to the atmosphere), the retracting cylinder valve time delay 120 times out and enables the pilot 119 to move the retracting cylinder valve 106 to the first position (left), causing pressure from line 102 to pass to line 110 and venting line 108 to the atmosphere. This occurs as soon as the operator releases the switch 58. The retracting mechanism 57 then extends the basin 26 and mandrel 22, deactivating the packer arm valve 62 as seen in FIG. 7. The packer arm valve 62 having returned to its original position, line 114 is pressurized and line 112 is vented to the atmosphere. The rotary actuator 32 is thus pressurized to rotate the packer arm 30 clockwise about its vertical axis 66 into the extended position. The packer arm now extended and the stapling and cutting portion of the bottom forming device having released the formed bag, the operator can move the bag 78 from the machine as shown in FIG. 5. Furthermore, the retracting mechanism has moved the mandrel and basin into the extended position, so that the operator may repeat the cycle.

To form bags of various lengths, the machine 20 is provided with a crank 140, gears 142, chains 143, and screws 144 to vertically adjust the height of a major support plate 146 as shown in FIGS. 1 and 7. In FIG. 7, a first tube 148 is vertically attached to the major support plate. A swing arm 150 rotatably and slidably connects the first tube to a second tube 152 which is slidably and rotatably engaged with the bottom forming device 28. Thus, the bottom forming device is horizontally and vertically adjustable with respect to the basin 26 and mandrel 22, to adjust the height above the basin where the bottom of a bag is to be formed. Mandrels of differing diameter can be used to expand continuous rope net material of differing lay-flat dimensions and still fit between the basin and the bottom forming device. The major support plate also supports the slides 59 which support the basin mounting tray 58 in addition to the first tube 148 which supports the bottom forming device. Rotation of the crank 140 will therefore provide vertical adjustment of the distance between the basin, mandrel and bottom forming device with the bag operated switch 56. Thus bags of different lengths can be formed by adjusting crank 140.

It will be appreciated that other variations and embodiments of the invention are contemplated and that this description does not limit the scope of the invention as determined by the claims which follow.

I claim:

1. A net bag forming machine for spreading and opening continuous tubular rope net material which has been radially compacted and stored on a reel, comprising:

a free-floating, heavy spherical mandrel which is free to rotate about three perpendicular axes for expanding continuous rope net bag material;

a basin having a depression for entrapping the mandrel against substantial lateral movement and for supporting the mandrel; and means within the basin for guiding the net bag material through the basin to the mandrel, wherein the mandrel slides within the tubular net bag material and is supported by the basin to spread the material for receiving articles to be bagged.

2. The machine of claim 1 wherein the guiding means within the basin is an aperture having a minimum dimension which is less than the diameter of the spherical mandrel to prevent the mandrel from passing through the aperture.

3. The machine of claim 2 wherein the basin has a hemispherical depression having a radius of curvature which is greater than the radius of the mandrel.

4. The machine of claim 3 wherein the basin and mandrel are constructed from ultra high molecular weight polyethylene and wherein the surface of contact between the basin and mandrel is smooth.

5. The machine of claim 1 wherein the spherical mandrel is weighted to overcome the natural tendency of the net material to constrict and to expand the material to its lay-flat dimension.

6. The machine of claim 1 in combination with a bottom forming device having means for sealing a portion of the net bag material which has been expanded by the mandrel to form the bottom of a bag and means for separating the bag from the continuous net material.

7. The machine of claim 6, including means for positioning the basin and mandrel in the vicinity of the bottom forming device so that a portion of the expanded net bag material can be introduced into the bottom forming device.

8. The machine of claim 7, including means for gathering and holding a portion of the expanded net bag material above the mandrel within the means for separating and sealing the material, and means for raising and lowering the basin and bottom forming device to form bags of various lengths.

9. The machine of claim 7 wherein the means for positioning the basin and mandrel in the vicinity of the bottom forming device has a sliding mechanism having an extended position and a retracted position, wherein the extended position enables a human operator to grasp a portion of the net material on the surface of the mandrel without interference from the bottom forming device and wherein the retracted position allows the separating and sealing means to function at a distance from the operator.

10. The machine of claim 9, including control means for actuating the bottom forming device, the means for positioning the basin and mandrel, and the means for gathering and holding the material within the separating and sealing means.

11. The machine of claim 10, including means for initiating the control means.

12. The machine of claim 11, including a bag operated switch having a protruding portion to enable an operator to hook the top portion of a bag around the switch and whereby pulling on the bag will operate the switch and cycle the initiating means, and means for adjusting the distance between the mandrel and bottom forming device with the bag operated switch so that bags of various lengths can be formed.

13. The invention of claim 1, including means for supplying continuous rope net material from a roll.

14. The invention of claim 13 wherein the net material supplying means is a tangential reel dispenser comprising:

an axle for mounting a roll of continuous rope net material;

a motor for rotating the axle;

a switch for controlling the motor, to start the motor when the switch is enabled; and a sensing mechanism attached to the switch to operate the motor when the tension in the rope net material reaches a predetermined value.

15. The machine of claim 14 wherein the motor includes a time delay mechanism to unroll approximately 20 feet of rope net material when the switch is activated.

16. The machine of claim 1, including means for filling a completed net bag with a predetermined volume of articles.

17. A method for forming tubular net bags from a reel of continuous rope net material comprising the following steps:

drawing continuous rope net material upwardly through a supporting means;

feeding the material around a free-floating spherical mandrel of sufficient weight to expand the net material to its lay-flat dimension and free to rotate about three perpendicular axes;

closing a portion of the expanded net material above the mandrel to form the bottom of a net bag;

separating the bottom of the bag from the continuous net material; and loading the bag with a predetermined volume of articles wherein the maximum vertical distance through which the articles must fall does not exceed the length of the bag, thereby preventing bruising of delicate produce.

18. The method of claim 17, further comprising the step of unrolling a predetermined amount of material from the reel when the tension in the material reaches a predetermined value.

19. The method of claim 17, including the step of placing the mandrel and basin within the vicinity of an operator when the operator draws the net material through the mandrel and removing the basin and mandrel from the vicinity of the operator when the bottom of the bag is formed.

20. A net bag forming machine for spreading and opening continuous tubular rope net material which has been radially compacted and stored on a reel, comprising:

a heavy mandrel having a smooth surface which is free to rotate about three perpendicular axes for expanding continuous rope net material;

a basin having a depression wherein the depression is sized to prevent substantial horizontal lateral movement of the mandrel and to support the mandrel;

an aperture in the basin for guiding continuous tubular net bag material through the basin and to the mandrel;

the basin and mandrel confronting one another with opposed surfaces to define a common space there between; and wherein the common space remains open and unobstructed with no structure protruding between the mandrel and the basin within the common space.

21. The machine of claim 20, including a stapling and cutting mechanism to form the bottom of a bag on a portion of the expanded net material.

22. The machine of claim 21, including a packer arm for crowding a portion of the expanded material into the cutter and the stapler, and a mechanism for sliding the basin and the mandrel, wherein the basin and mandrel have an extended position in the vicinity of an operator and a retracted position in the vicinity of the cutting mechanism and the stapling mechanism.

* * * * *